US006633039B2

(12) United States Patent
Sakai

(10) Patent No.: US 6,633,039 B2
(45) Date of Patent: Oct. 14, 2003

(54) ELECTROMAGNETS FOR AND METHOD OF DEFLECTING AND SPLITTING A PARTICLE BEAM

(75) Inventor: Izumi Sakai, Tsukuba (JP)

(73) Assignee: High Energy Accelerator Research Organization, Tsukuba (JP)

( * ) Notice: Subject to any disclaimer, the term of this patent is extended or adjusted under 35 U.S.C. 154(b) by 0 days.

(21) Appl. No.: 10/094,415

(22) Filed: Mar. 8, 2002

(65) Prior Publication Data

US 2002/0148973 A1 Oct. 17, 2002

(30) Foreign Application Priority Data

Mar. 8, 2001 (JP) ..... 2001-064712

(51) Int. Cl.[7] ..... H01S 37/09

(52) U.S. Cl. ..... 250/396 ML; 250/492.2; 250/492.3; 378/34

(58) Field of Search ..... 250/396 ML

(56) References Cited

U.S. PATENT DOCUMENTS 4,996,496 A * 2/1991 Kitamura et al. ..... 315/501

5,073,913 A * 12/1991 Martin ..... 378/34

FOREIGN PATENT DOCUMENTS

JP 08078199 A 3/1996 ..... H05H/13/04
WO WO 86028-1 * 5/1986

* cited by examiner

*Primary Examiner*—John R. Lee
*Assistant Examiner*—James J. Leybourne
(74) *Attorney, Agent, or Firm*—Stoel Rives LLP

(57) ABSTRACT

A septum electromagnet deflects and splits a particle beam. A preferred embodiment of the septum electromagnet comprises a septum conductor that divides the septum electromagnet to define first and second beam deflecting magnetic pole spaces. First and second magnetic fields are generated in, respectively, the first and second beam deflecting magnetic pole spaces by electric currents flowing through the coils associated with the septum conductor. The direction of the first magnetic field is opposite to the direction of the second magnetic field, such that a particle beam passing through the first beam deflecting magnetic pole space is angularly deflected by an amount and a particle beam passing through the second beam deflecting magnetic pole space is angularly deflected by an opposite amount.

17 Claims, 5 Drawing Sheets

ELECTROMAGNETS FOR AND METHOD OF DEFLECTING AND SPLITTING A PARTICLE BEAM

RELATED APPLICATIONS

This application claims priority from Japanese Patent Application No. 2001-64,712 under 35 U.S.C. §119.

TECHNICAL FIELD

The present invention relates to a septum electromagnet for deflecting and splitting a particle beam, an electromagnet for deflecting and splitting a particle beam, and a method of deflecting a particle beam. The present invention is useful for introducing particle beams into and extracting particle beams from a charged particle accelerator.

BACKGROUND OF THE INVENTION

Conventionally, a septum electromagnet is used to introduce particle beams into and extract particle beams from a charged particle accelerator. FIGS. 1 and 2 are, respectively, transverse and longitudinal cross sectional views of a conventional septum electromagnet. With reference to FIGS. 1 and 2, an electric current flowing through a storehouse-shaped coil that includes an inner conductor 1 and a septum conductor 3 generates inside a yoke 5 a magnetic field B in a direction perpendicular to the plane of FIG. 1. Since it is shielded by septum conductor 3, the magnetic field B cannot leak beyond yoke 5.

A conventional septum magnet of a type shown in FIGS. 1 and 2 can be used to deflect the path of a particle beam that passes through the magnetic field B. The magnetic field B deflects by an angle θ, and thereby varies, a given orbit (lead-orbit) of a particle beam as it passes through the accelerator. Because septum conductor 3 shields magnetic field B, a beam having an orbit (round-orbit) that passes beyond the septum electromagnet cannot be deflected by the magnetic field B. A given particle beam can, therefore, be removed from the charged particle accelerator by passing the given particle beam through the septum electromagnet.

A drawback of the septum electromagnet as shown in FIGS. 1 and 2 is that septum conductor 3 requires a strong support structure to withstand the very large electromagnetic force exerted by magnetic field B. However, because there is only a small amount of space in the septum electromagnet, it is difficult to provide an adequate support member for septum conductor 3 in the septum electromagnet.

Moreover, if the strength of the magnetic field B is increased, yoke 5 may be saturated in permeability and thereby cause partial leakage of the magnetic field B beyond yoke 5 and a consequent deflection of particle beams on the round-orbit. To reduce leakage of magnetic field B, a magnetically shielding plate (not shown) may be positioned adjacent septum conductor 3, but this configuration may deteriorate the performance of the septum electromagnet because of the substantial increase of the thickness of septum conductor 3.

SUMMARY OF THE INVENTION

It is an object of the present invention to provide a new septum electromagnet for deflecting and splitting a particle beam, a new electromagnet for deflecting and splitting a particle beam, and a method of deflecting a particle beam using the septum electromagnet or the electromagnet.

The present invention relates to a septum electromagnet for deflecting and splitting a particle beam. A preferred embodiment of the septum electromagnet comprises a septum conductor that divides the septum electromagnet to define first and second beam deflecting magnetic pole spaces. First and second magnetic fields are generated in, respectively, the first and second beam deflecting magnetic pole spaces by electric currents flowing through the coil of the septum conductor. The direction of the first magnetic field is opposite to the direction of the second magnetic field, such that a particle beam passing through the first beam deflecting magnetic pole space is angularly deflected by an amount and a particle beam passing through the second beam deflecting magnetic pole space is angularly deflected by an opposite amount.

The septum electromagnet of the present invention may be disposed on a particle beam orbit of a charged particle accelerator. A beam on a lead-orbit and a beam on a round-orbit in the charged particle accelerator pass through, respectively, the first and second beam deflecting magnetic pole spaces of the septum electromagnet.

A first magnetic field is generated at the first beam deflecting magnetic pole space, and a second magnetic field is generated at the second beam deflecting magnetic pole space. Since the direction of the first magnetic field is preferably opposite to that of the second magnetic field, electromagnetic forces having opposite directions act on the particle beams on the lead-orbit and the round-orbit. This results in deflection of a particle beam on the lead-orbit in a direction opposite that of the deflection of a particle beam on the round-orbit. The lead-orbit and the round-orbit of the particle beams are sufficiently variable that the two particle beams can be split. This enables extraction of a particle beam from the charged particle accelerator.

Conversely, reversing the direction of the first and second beam deflecting magnetic pole spaces enables introduction of a particle beam into the charged particle accelerator.

The septum magnet of the present invention is divided by the septum conductor to define the first beam deflecting magnetic pole space and the second beam deflecting magnetic pole space. Therefore, the first and the second magnetic fields exert forces on the septum conductor. Because the first and second magnetic fields exert forces in opposite directions, they cancel each other out near the septum conductor. The septum conductor can, as a consequence, be supported in the septum electromagnet more easily than in conventional septum electromagnets.

For example, if the first magnetic field leaks beyond the first deflecting magnetic pole space of the septum electromagnet, any leaked component of the first magnetic field will be cancelled by a leaked component of the second magnetic field. Because the net magnetic leakage for the septum electromagnet is inhibited by the presence of magnetic fields in opposite directions, a magnetic shielding plate is not needed.

An aspect of the invention relates to an electromagnet for deflecting and splitting a particle beam. The electromagnet comprises a septum electromagnet that is divided into a first beam deflecting magnetic pole space and a second beam deflecting magnetic pole space by a combination of a septum conductor and an auxiliary electromagnet. First and second magnetic fields of preferably opposite directions are generated in, respectively, the first and second beam deflecting magnetic pole spaces by electric currents flowing on the coils of a septum conductor. Thus, a first particle beam passing through the first beam deflecting magnetic pole space is angularly deflected in a direction that is opposite to the direction of angular deflection of a particle beam passing through the second beam deflecting pole space. The deflection of a beam that passed through the second beam deflecting magnetic pole space is further offset, or cancelled out, by a deflection imparted by the auxiliary electromagnet.

An auxiliary electrode is provided in addition to the septum electromagnet as mentioned above. The auxiliary electrode can offset and thereby cancel out the deflection imparted to a particle beam passing through the second beam deflecting magnetic pole space. A particle beam on a round-orbit is not deflected, therefore, and continues to move on the same round-orbit.

As a result, the electromagnet of the present invention deflects and splits only a beam on a lead-orbit, which is taken out of a charged particle accelerator without disturbing the acceleration of a beam on a round-orbit.

Additional aspects and advantages of this invention will be apparent from the following detailed description of preferred embodiments thereof, which proceeds with reference to the accompanying drawings.

DETAILED DESCRIPTION OF PREFERRED EMBODIMENTS

Figure 1:
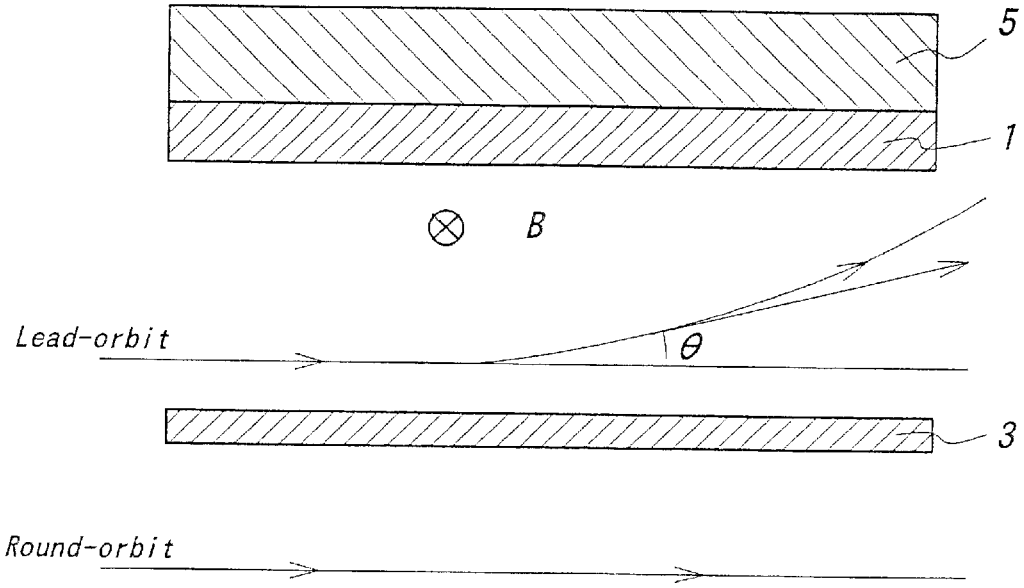
FIG. 1 (PRIOR ART)
FIG. 1 is a transverse cross sectional view of a conventional septum electromagnet.
Figure 2:
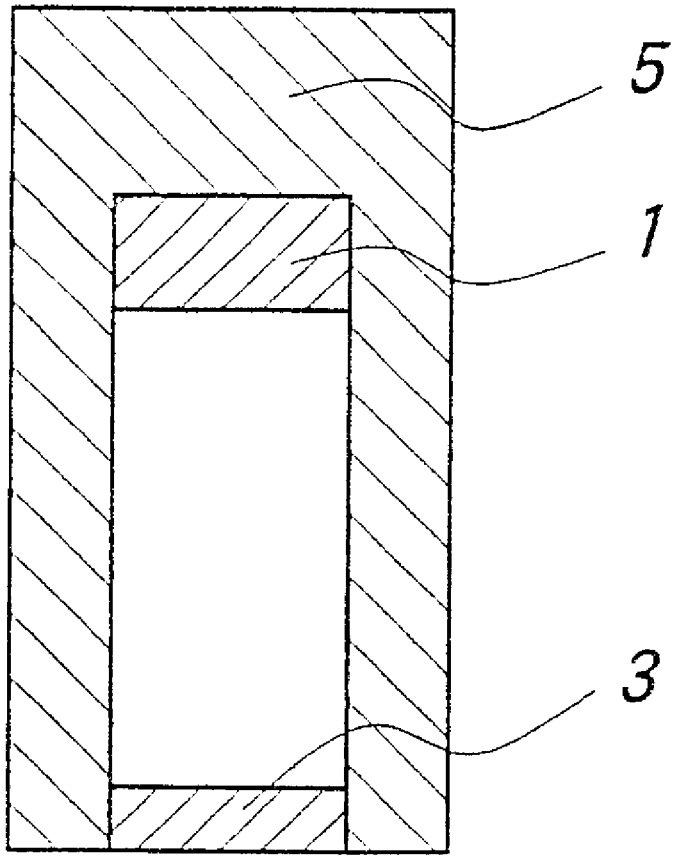
FIG. 2 (PRIOR ART)
FIG. 2 is a longitudinal cross sectional view of the conventional septum electromagnet of FIG. 1.
Figure 3:
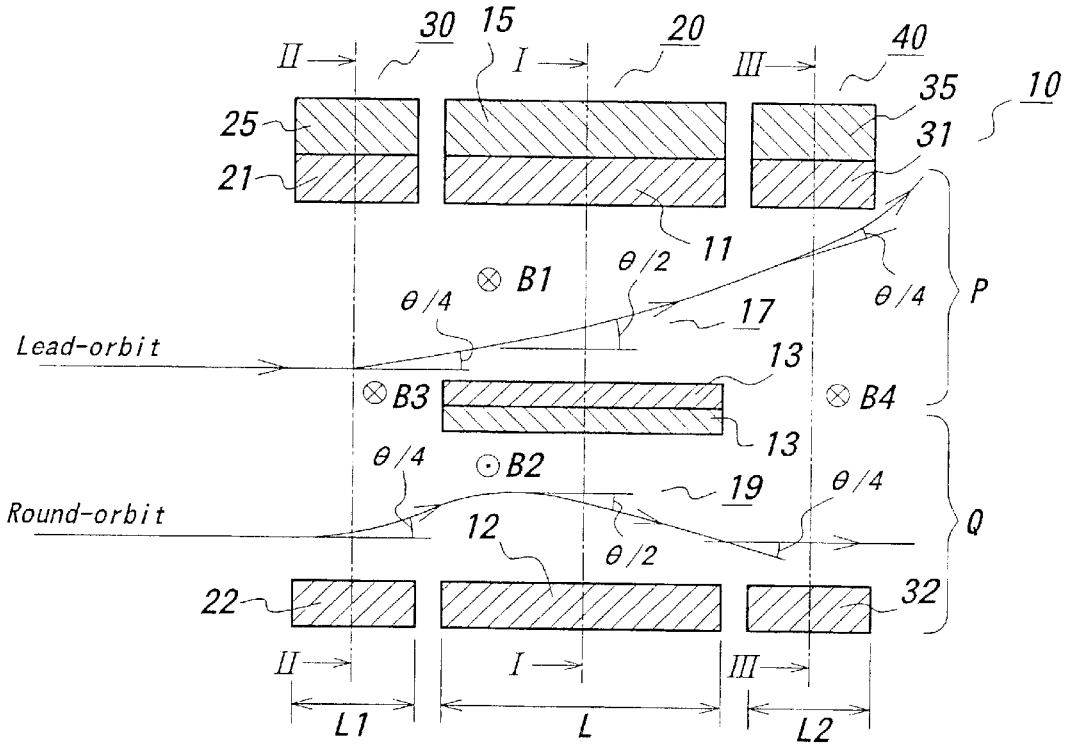
FIG. 3 is a transverse cross sectional view of a preferred embodiment of an electromagnet according to the present invention.
Figure 4:
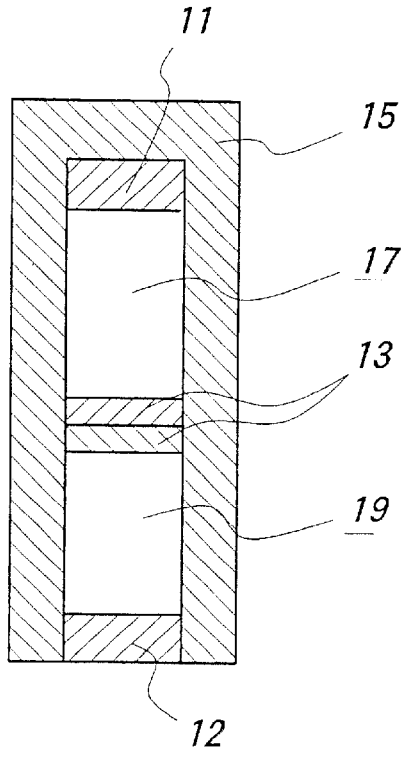
FIG. 4 is a longitudinal sectional view taken along lines I—I of FIG. 3.
Figure 5:
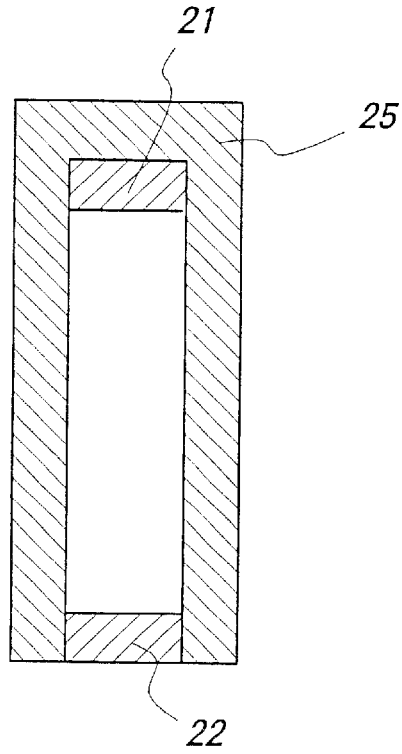
FIG. 5 is a longitudinal sectional view taken along lines II—II of FIG. 3.
Figure 6:
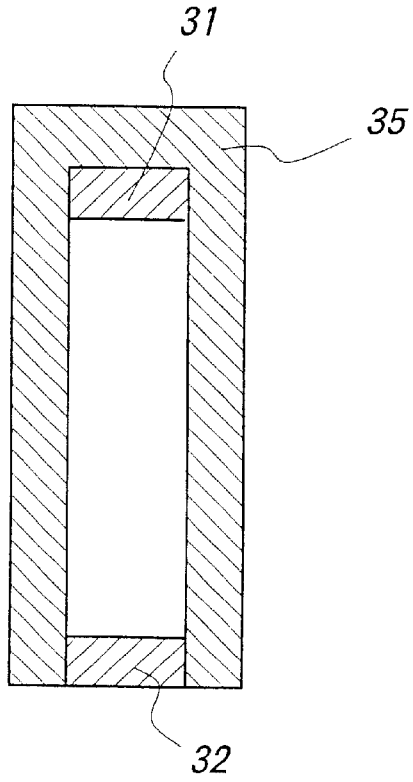
FIG. 6 is a longitudinal sectional view taken along lines III—III of FIG. 3.

FIG. 3 is a transverse cross sectional view of a preferred embodiment of an electromagnet 10 according to the present invention. FIGS. 4, 5, and 6 are longitudinal sectional views of electromagnet 10 taken on, respectively, lines I—I, lines II—II, and lines III—III of FIG. 3.

With reference to FIGS. 3–6, electromagnet 10 includes a septum electrode 20 for deflecting and splitting a particle beam directed at the center of septum electrode 20. According to the present invention, a septum electromagnet 20 is positioned between a first (front) auxiliary electromagnet 30 and a second (rear) auxiliary electromagnet 40 so that an incoming particle beam will move successively past first auxiliary electromagnet 30, septum electrode 20, and second auxiliary electromagnet 40.

Septum electrode 20 includes inner conductors 11 and 12 inside a yoke 15, and a double structured septum conductor 13 at a center of septum electrode 20. First auxiliary electromagnet 30 includes inner conductors 21 and 22 inside a yoke 25, and second auxiliary electromagnet 40 includes inner conductors 31 and 32 inside a yoke 35.

Figure 7:
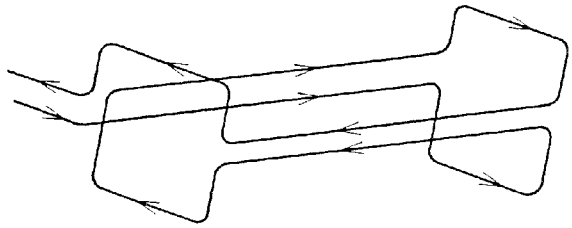
FIG. 7 is a diagram showing the direction of flow of a first electric current through the electromagnet.

A predetermined electric current flowing through a first storehouse-shaped coil (not shown) provided alongside yoke 15 of septum electrode 20 generates a first magnetic field B1 in the area between inner conductor 11 and septum conductor 13. The first storehouse-shaped coil is composed of inner conductor 11 and septum conductor 13 and is defined by the region P. Preferably, the predetermined electric current flows through the storehouse-shaped coil in a direction as shown in FIG. 7. The area between inner conductor 11 and septum conductor 13 defines a first beam deflecting magnetic pole space 17. Magnetic field B1 has a direction that is perpendicular to and extends outwardly of the plane of FIG. 3.

Figure 8:
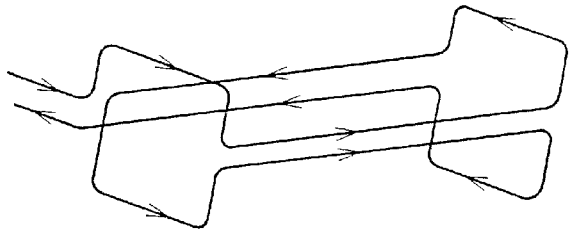
FIG. 8 is a diagram showing the direction of flow of a second electric current through the electromagnet.

A second predetermined electric current flowing through a second storehouse-shaped coil (not shown) provided alongside yoke 15 of septum electrode 20 generates a second magnetic field B2 in the area between inner conductor 12 and septum conductor 13. The second storehouse-shaped coil is composed of inner conductor 12 and septum conductor 13 and defined by the region Q. Preferably, the second predetermined electric current flows through the second storehouse-shaped coil in a direction as shown in FIG. 8. The area between inner conductor 12 and septum conductor 13 defines a second beam deflecting magnetic pole space 19. Magnetic field B2 has a direction that is perpendicular to and extends inwardly toward the plane of FIG. 3.

Storehouse-shaped coils (not shown) are provided alongside yokes 25 and 35 of the respective first and second auxiliary electromagnets 30 and 40. Electric currents flow through inner conductors 21 and 22 and the coil associated with yoke 25 and inner conductors 31 and 32 and the coil associated with yoke 35 in the direction shown in FIG. 7. Under these conditions, third and fourth magnetic fields B3 and B4 are generated in the spaces of, respectively, first and second electromagnets 30 and 40 in a direction that is perpendicular to and extends outwardly of the plane of FIG. 3.

The absolute values of magnetic fields B1–B4 are preferably equal. First auxiliary electromagnet 30 has a length L1 that is equal to a length L2 of second auxiliary electromagnet 40. Septum electromagnet 20 has a length L, which is preferably twice the length of L1 and L2.

Electromagnet 20 shown in FIGS. 3–6 is positioned in a charged particle accelerator so that, for example, a particle beam on a lead-orbit is introduced into the upper side of electromagnet 10. Magnetic field B3 deflects the particle beam on the lead-orbit upwardly by an angle of $\theta/4$ when it passes by first auxiliary electromagnet 30. The particle beam then passes into first beam deflecting magnetic pole space 17 defined by inner conductor 11 and septum conductor 13 of septum electromagnet 20.

Since length L of septum electromagnet 20 is twice the value of length L1 of first auxiliary electromagnet 30, an electromagnetic force having twice the strength as the electromagnetic force in the region of first auxiliary electromagnet 30 acts on the particle beam. The particle beam in this region of electromagnet 10 is, therefore, deflected upward by an angle of $\theta/2$. After passing through first beam deflecting magnetic pole space 17, the particle beam passes into the area of second auxiliary electromagnet 40. The length of second auxiliary electromagnet 40 is equal in length to first auxiliary electromagnet 30. As in the case of auxiliary electromagnet 30, the particle beam is, therefore, deflected upward by an angle of $\theta/4$ when it passes by second auxiliary electromagnet 40. As a result, the particle beam traveling on the lead-orbit and passing through electromagnet 10 is deflected upward by a total angle of $\theta$.

On the other hand, a particle beam on a round-orbit is introduced into the lower side of electromagnet 10. Magnetic field B3 deflects the particle beam upwardly by an angle of θ/4 when it passes by first auxiliary electromagnet 30, as described above. The particle beam then passes into second beam deflecting magnetic pole space 19 defined by inner conductor 12 and septum conductor 13 of septum electromagnet 20. Second magnetic field B2 is generated in second beam deflecting magnetic pole space 19 and is equal in strength to first magnetic field B1 but has a direction opposite to that of first magnetic field B1. As a result, the particle beam is deflected downward by an angle of θ/2. The particle beam then passes into the area of second auxiliary electromagnet 40 and is deflected upward by an angle θ/4, as described above.

There is no net deflection of the particle beam travelling on the round-orbit because the deflection caused by first and second auxiliary electromagnets 30 and 40 is entirely offset by the deflection caused by septum electromagnet 20. Thus, the particle beam on the round-orbit travels along substantially the same path after passing through electromagnet 10.

Accordingly, the particle beam on the lead-orbit is deflected upward by the angle of θ when passing through electromagnet 10, and the particle beam on the round-orbit is not deflected and travels substantially unaltered through electromagnet 10. The particle beam on the lead-orbit can be easily split and taken out of the charged particle accelerator, and the particle beam on the round-orbit can travel in a substantially stable manner without deflection.

Both of first and second magnetic fields B1 and B2 exert electromagnetic forces on septum conductor 13. However, because the strengths of the first and second magnetic fields B1 and B2 are equal, the electromagnetic forces acting on septum conductor 13 substantially cancel each other. Thus, the structure of a supporting member for the septum conductor 13 can be simplified, as compared to conventional designs.

Because the electromagnetic forces acting on septum conductor 13 are substantially cancelled, pulse type electric current excitation may be substituted for direct current excitation. As a result, heat generation caused by current flowing through septum conductor 13 can be reduced, and septum conductor 13 can have a smaller thickness than that of conventional designs.

Moreover, even though first and second magnetic fields B1 and B2 may leak beyond septum electromagnet 20, any magnetic leakage components effectively cancel each other, thereby substantially reducing the amount of magnetic field leakage beyond septum electromagnet 20. This eliminates a need to employ a magnetic shielding plate and thereby enables more efficient performance of septum electromagnet 20.

Although it is used in the above embodiment to remove a particle beam from a charged particle accelerator, electromagnet 10 may also be used for introducing a particle beam into a charged particle accelerator. This is accomplished by changing the lead-orbit to an incidence-orbit. Particle beams on the incidence-orbit and the round-orbit are introduced into the electromagnet 10 from the right-hand side, and discharged from the left-hand side. As a result, the beams travel through the electromagnet 10 in a direction opposite to that described above and are thus introduced into the charged particle accelerator.

Although the present invention has been described in detail with reference to the above examples, the invention is not limited to the above embodiment and numerous variations and modifications may be made without departing from the scope of the present invention.

For example, in the above example first auxiliary electromagnet 30 and second auxiliary electromagnet 40 are positioned, respectively, in front of and behind septum electromagnet 20; however, the same effect can be achieved by positioning a single auxiliary magnet either in front of or behind septum electromagnet 20. In that case the single auxiliary electromagnet would need to produce a magnetic field substantially equal in strength to magnetic fields B1 and B2.

Also, in the above embodiment, the strengths of the first and second magnetic fields B1 and B2 are equal, but can be of different strengths without departing from the scope of the present invention. Setting the strength of first magnetic field B1 equal to that of second magnetic field B2 sets, however, the deflection angle of a particle beam passing through first beam deflecting magnetic pole space 17 equal to that of the particle beam passing through the second beam deflecting magnetic pole space 19, and thereby simplifies control of the path of the particle beam.

Length L of septum electromagnet 20 is preferably set equal to the sum of length L1 of first auxiliary electromagnet 30 and length L2 of second auxiliary electromagnet 40, but the criterion for setting length L may be modified without departing from the scope of the present invention. Setting length L equal to the sum of lengths L1 and L2 and setting the strengths of the magnetic fields B1–B4 equal to one another, as mentioned above, causes, however, no net deflection of the beam on the round-orbit, and net deflection of only the beam on the lead-orbit.

It will be obvious to those having skill in the art that many changes may be made to the details of the above-described embodiments of this invention without departing from the underlying principles thereof. The scope of the present invention should, therefore, be determined only by the following claims.

What is claimed is:

1. A septum electromagnet for deflecting a particle beam, comprising:

first and second coils;

a septum conductor positioned to divide a septum electromagnet into first and second beam deflecting magnetic pole spaces, the first beam deflecting magnetic pole space associated with the first coil and the second beam deflecting magnetic pole space associated with the second coil;

the first coil, when conducting an electric current, generating a first magnetic field having a first field direction in the first beam deflecting magnetic pole space, and the second coil, when conducting an electric current, generating a second magnetic field having a second field direction in the second beam deflecting magnetic pole space, the first and second field directions being opposite to each other; and the first magnetic field having a first magnetic field strength and operating to angularly deflect in a first deflection direction a first particle beam traveling through the first beam deflecting magnetic pole space, and a second magnetic field having a second magnetic field strength and operating to angularly deflect in a second deflection direction a second particle beam traveling through the second beam deflecting magnetic pole space, the first and second deflection directions being opposite to each other.

2. The septum electromagnet of claim 1, in which the first and second magnetic field strengths are substantially equal.

3. The septum electromagnet of claim 1, in which the first magnetic field in the first beam deflecting magnetic pole space angularly deflects the first particle beam as it leaves the septum electromagnet.

4. The septum electromagnet of claim 1, in which the first magnetic field in the first beam deflecting magnetic pole space angularly deflects the first particle beam as it enters the septum electromagnet.

5. An electromagnet for deflecting a particle beam, comprising:

first, second, and third coils;

a septum electromagnet having first and second ends;

a septum conductor positioned to divide the septum electromagnet into first and second beam deflecting magnetic pole spaces, the first beam deflecting magnetic pole space associated with the first coil and the second beam deflecting magnetic pole space associated with the second coil;

the first coil, when conducting an electric current, generating a first magnetic field having a first field direction in the first beam deflecting magnetic pole space, and the second coil, when conducting an electric current, generating a second magnetic field having a second field direction in the second beam deflecting magnetic pole space, the first and second field directions being opposite to each other;

the first magnetic field having a first magnetic field strength and operating to angularly deflect in a first deflection direction a first particle beam traveling through the first beam deflecting magnetic pole space, and the second magnetic field having a second magnetic field strength and operating to angularly deflect in a second deflection direction a second particle beam traveling through the second beam deflecting magnetic pole space, the first and second deflection directions being opposite to each other;

an auxiliary electromagnet positioned proximal to an end of the septum electromagnet and associated with the third coil; and the third coil, when conducting an electric current, generating a third magnetic field having a third field direction and a third magnetic field strength in an area adjacent to the auxiliary electromagnet to angularly deflect in the first deflection direction a particle beam travelling through the electromagnet.

6. The electromagnet of claim 5, in which the first and second magnetic field strengths are substantially equal.

7. The septum electromagnet of claim 6, in which the first and third magnetic field strengths are substantially equal.

8. The electromagnet of claim 5, in which the auxiliary electromagnet comprises first and second sub-auxiliary electromagnets positioned proximal to respective first and second ends of the septum electromagnet, and in which the third coil comprises first and second sub-coils associated with respective first and second sub-auxiliary electromagnets.

9. The electromagnet of claim 8, in which the first and second magnetic field strengths are substantially equal.

10. The electromagnet of claim 8, in which wherein the first, second and third magnetic field strengths are substantially equal.

11. The electromagnet of claim 10, in which the first and second sub-coils are generating equal parts of the third electric field.

12. The electromagnet of claim 5, in which the first beam deflecting magnetic pole space is positioned to deflect the first particle beam as it leaves the electromagnet.

13. The magnet of claim 5, in which the first beam deflecting magnetic pole space is positioned to deflect the first particle beam as it enters the electromagnet.

14. A method for deflecting a particle beam, comprising:

providing a septum electromagnet;

positioning a septum conductor to divide the septum electromagnet into first and second beam deflecting magnetic pole spaces;

applying first and second electric currents to respective first and second coils, the first and second coils generating a first magnetic field having a first field direction and strength and a second magnetic field having a second field direction and strength that is opposite the first field direction in respective first and second beam deflecting magnetic pole spaces; and passing a first particle beam through the first beam deflecting magnetic pole space, and passing a second particle beam through the second beam deflecting magnetic pole space, the first particle beam being deflected by a first predetermined angle and the second particle beam being deflected by a second predetermined angle that is opposite of the first predetermined angle.

15. A deflecting method according to claim 14, further comprising:

providing an auxiliary electromagnet positioned proximal to an end of the septum electromagnet; and applying a third electric current to a third coil, the third coil generating a third magnetic field having a third field direction that is equal to the first field direction and a third field strength that is equal to the second field strength, whereby the deflection of the second particle beam caused by the second magnetic field is offset by the deflection caused by the third magnetic field.

16. A deflecting method according to claim 14, wherein in response to an appropriate applied first current the first beam deflecting magnetic pole space is operable to deflect the first particle beam when it exits the electromagnet.

17. A deflecting method according to claim 14, wherein in response to an appropriate applied first current the first beam deflecting magnet pole space is operable to deflect a particle beam when it enters the electromagnet.

* * * * *